US010151285B2

(12) United States Patent
Seki

(10) Patent No.: US 10,151,285 B2
(45) Date of Patent: Dec. 11, 2018

(54) FUEL INJECTION DEVICE

(71) Applicant: DENSO CORPORATION, Kariya, Aichi-pref. (JP)

(72) Inventor: Kazuho Seki, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/523,974

(22) PCT Filed: Feb. 16, 2016

(86) PCT No.: PCT/JP2016/000797

§ 371 (c)(1),
(2) Date: May 3, 2017

(87) PCT Pub. No.: WO2016/143264

PCT Pub. Date: Sep. 15, 2016

(65) Prior Publication Data

US 2017/0356409 A1 Dec. 14, 2017

(30) Foreign Application Priority Data

Mar. 9, 2015 (JP) ..... 2015-046184

(51) Int. Cl.
*F02M 47/02* (2006.01)
*F02M 55/00* (2006.01)
(Continued)

(52) U.S. Cl.
CPC ..... *F02M 55/002* (2013.01); *F02M 47/00* (2013.01); *F02M 47/02* (2013.01);
(Continued)

(58) Field of Classification Search
CPC ..... F02M 55/002; F02M 55/008; F02M 47/02
See application file for complete search history.

(56) References Cited

U.S. PATENT DOCUMENTS 4,962,887 A * 10/1990 Matsuoka ..... F02M 47/02 239/124
5,779,149 A * 7/1998 Hayes, Jr. ..... F02M 47/027 239/124

(Continued)

FOREIGN PATENT DOCUMENTS

JP 2002-322960 11/2002
JP 2016-166562 9/2016

*Primary Examiner* — Sizo Vilakazi
*Assistant Examiner* — Kevin R Steckbauer
(74) *Attorney, Agent, or Firm* — Nixon & Vanderhye P.C.

(57) ABSTRACT

A fuel injection device injecting a fuel from an injection hole to a combustion chamber of an internal combustion engine includes a valve body including a fuel passage through which the fuel flows to the injection hole and a seat portion facing the fuel passage, a valve member moving in the valve body in an axial direction of the valve body and opening and closing the injection hole by being removed from and seated on the seat portion, a dividing member defining a pressure control chamber placed at a position opposite to the injection hole with respect to the valve member, and an outer peripheral member surrounding an exterior of an outer periphery of the dividing member. The pressure control chamber controls a movement of the valve member by a pressure of the fuel that is introduced. The outer peripheral member and the valve body constitute the fuel passage.

8 Claims, 6 Drawing Sheets

(51) Int. Cl.

| | |
|---|---|
| ***F02M 47/00*** | (2006.01) |
| ***F02M 61/16*** | (2006.01) |
| ***F02M 61/04*** | (2006.01) |
| ***F02M 61/18*** | (2006.01) |

(52) U.S. Cl.
CPC ..... *F02M 47/027* (2013.01); *F02M 55/004* (2013.01); *F02M 55/007* (2013.01); *F02M 55/008* (2013.01); *F02M 61/04* (2013.01); *F02M 61/16* (2013.01); *F02M 61/18* (2013.01); *F02M 2200/708* (2013.01)

(56) References Cited

U.S. PATENT DOCUMENTS

| | | | | |
|---|---|---|---|---|
| 8,544,767 | B2 * | 10/2013 | Adachi ..... | F02M 47/027<br>123/445 |
| 2002/0008158 | A1 * | 1/2002 | Kuzuyama ..... | F02M 57/025<br>239/95 |
| 2004/0231645 | A1 | 11/2004 | Magel | |
| 2005/0224598 | A1 | 10/2005 | Potz et al. | |
| 2009/0184185 | A1 * | 7/2009 | Lewis ..... | F02M 47/027<br>239/585.5 |
| 2012/0012680 | A1 * | 1/2012 | Adachi ..... | F02M 47/027<br>239/533.2 |
| 2012/0042852 | A1 | 2/2012 | Yamada et al. | |
| 2012/0152206 | A1 | 6/2012 | Adachi et al. | |
| 2012/0205470 | A1 * | 8/2012 | Spindler ..... | F02M 47/027<br>239/585.5 |

* cited by examiner

FUEL INJECTION DEVICE

CROSS REFERENCE TO RELATED APPLICATION

This application is the U.S. national phase of International Application No. PCT/JP2016/000797 filed Feb. 16, 2016, which designated the U.S. and claims priority to Japanese Patent Application No. 2015-46184 filed on Mar. 9, 2015, the disclosure of each of which are incorporated herein by reference.

TECHNICAL FIELD

The present disclosure relates to a fuel injection device which injects a fuel that is supplied into a combustion chamber of an internal combustion engine.

BACKGROUND ART

Conventionally, as disclosed in Patent document 1, a fuel injection device includes a nozzle body, a nozzle needle, and a cylinder. In the fuel injection device, the nozzle needle moves in the nozzle body in an axial direction of the nozzle body by a pressure of a fuel introduced in a pressure control chamber defined by a cylinder. Thus, an injection of the fuel injected from an injection hole is started and stopped according to the nozzle needle removed from and seated on a seat portion included in the nozzle body.

PRIOR ART LITERATURES

Patent Literature

Patent document 1: JP2012-21463A

SUMMARY OF INVENTION

Recently, it is strongly requested that a fuel amount that can be injected by the fuel injection device is increased. It is necessary that a stroke of the nozzle needle is extended to increase an injection amount that is the fuel amount. However, in the fuel injection device according to Patent document 1, it is difficult to extend the stroke of the nozzle needle.

Specifically, it is necessary that the seat portion is processed on the nozzle body. Generally, a processing of the seat portion is executed by inserting a tool into a fuel passage that is included in the nozzle body. In the above configuration, since the nozzle body surrounds an exterior of an outer periphery of the cylinder, the pressure control chamber and the cylinder are enlarged in the axial direction due to an extending of the stroke. In this case, the nozzle body is also enlarged in the axial direction. As a result, since a difficulty level of the processing of the seat portion is increased, a processing accuracy is deteriorated.

It is an object of the present disclosure to provide a fuel injection device in which a manufacturing accuracy of a seat portion is maintained and a length of a stroke can be improved.

According to an aspect of the present disclosure, the fuel injection device injects a fuel that is supplied from an injection hole to a combustion chamber of an internal combustion engine. The fuel injection device includes a valve body including a fuel passage through which the fuel flows to the injection hole and a seat portion facing the fuel passage, a valve member moving in the valve body in an axial direction of the valve body and opening and closing the injection hole by being removed from and seated on the seat portion, a dividing member defining a pressure control chamber placed at a position opposite to the injection hole with respect to the valve member, and an outer peripheral member surrounding an exterior of an outer periphery of the dividing member. The pressure control chamber controls a movement of the valve member by a pressure of the fuel that is introduced. The outer peripheral member and the valve body constitute the fuel passage.

According to the present disclosure, the outer peripheral member that constitutes the fuel passage through which the fuel flows to the injection hole with the valve body surrounds the exterior of the outer periphery of the dividing member defining the pressure control chamber. Thus, when the pressure control chamber and the dividing member are enlarged in the axial direction while the stroke of the valve body is extended, the outer peripheral member is enlarged in the axial direction, and a size of the valve body is maintained. Thus, a deterioration of the processing accuracy of when the seat portion is processed on the valve body can be suppressed, and a stroke amount of the valve member can be ensured.

BRIEF DESCRIPTION OF DRAWINGS

The above and other objects, features and advantages of the present disclosure will become more apparent from the following detailed description made with reference to the accompanying drawings. In the drawings.

DESCRIPTION OF EMBODIMENTS

Figure 1:
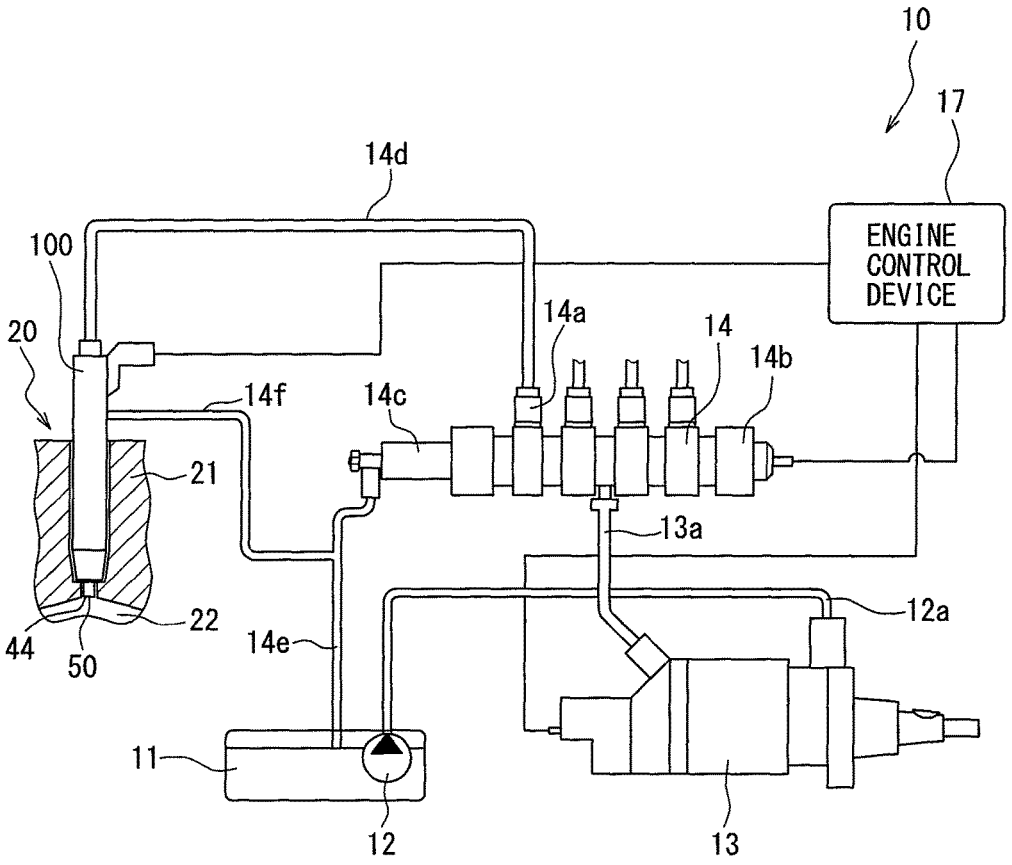
FIG. 1 is a diagram showing an outline of a fuel supply system to which a fuel injection device according to an embodiment of the present disclosure is applied.

A fuel supply system 10 shown in FIG. 1 includes a fuel injection device 100 according to an embodiment of the present disclosure. The fuel supply system 10 supplies a fuel to a combustion chamber 22 of a diesel engine 20 that is an internal combustion engine, by using the fuel injection device 100. The fuel supply system 10 includes a feed pump 12, a high-pressure fuel pump 13, a common rail 14, an engine control device 17, and the fuel injection device 100.

The feed pump 12 is an electric pump that is received in a fuel tank 11. The feed pump 12 applies the fuel stored in the fuel tank 11 with a feed pressure that is higher than a vapor pressure of the fuel. According to the present embodiment, the fuel may be a light oil. The feed pump 12 is connected with the high-pressure fuel pump 13 through a fuel pipe 12*a*. The feed pump 12 supplies the fuel that is applied with the feed pressure and is in a liquid-phase state to the high-pressure fuel pump 13.

The high-pressure fuel pump 13 is mounted to the diesel engine 20, and is driven by an output shaft of the diesel engine 20. The high-pressure fuel pump 13 is connected with the common rail 14 through a fuel pipe 13*a*. The high-pressure fuel pump 13 further compresses the fuel supplied by the feed pump 12 and then outputs a high-pressure fuel that is supplied to the common rail 14. The high-pressure fuel pump 13 includes an electromagnetic valve that is electrically connected with the engine control device 17. Since the engine control device 17 controls an opening and closing of the electromagnetic valve, a pressure of the fuel supplied from the high-pressure fuel pump 13 to the common rail 14 is adjusted to be a predetermined pressure.

The common rail 14 is a member that is a tubular shape and is made of a metal material such as a chrome molybdenum steel. The common rail 14 includes plural branch portions 14*a*, and a total number of the branch portions 14*a* is established according to a total number of cylinders of the diesel engine 20. Each of the branch portions 14*a* is connected with one of plural fuel injection devices 100 through a fuel pipe 14*d*. The common rail 14 is temporarily stores the high-pressure fuel supplied from the high-pressure fuel pump 13, and distributes the high-pressure fuel to the fuel injection devices 100 while the pressure of the high-pressure fuel is maintained.

The common rail 14 includes a common rail sensor 14*b* and a pressure regulator 14*c*. The common rail sensor 14*b* is electrically connected with the engine control device 17. The common rail sensor 14*b* detects the pressure of the fuel and a temperature of the fuel and outputs the pressure and the temperature to the engine control device 17. The pressure regulator 14*c* is placed at an end portion of the common rail 14. The pressure regulator 14*c* depresses the fuel that is excessive and then discharges the fuel to a low pressure area while maintaining the pressure of the fuel in the common rail 14 to be constant. The fuel that is discharged from the pressure regulator 14*c* is returned to the fuel tank 11 through a fuel pipe 14*e* interposed between the common rail 14 and the fuel tank 11. In this case, the fuel that is discharged from the pressure regulator 14*c* is referred to as an excessive fuel.

The engine control device 17 is constituted by a microcomputer including a processor that is used as a calculation circuit, a RAM, and a storing medium that is writable and nonvolatile. The engine control device 17 is electrically connected with various sensors including the common rail sensor 14*b* and a rotation speed sensor that detects a rotation speed of the diesel engine 20. The engine control device 17 outputs control signals that control the electromagnetic valve of the high-pressure fuel pump 13 and a valve mechanism of each of the fuel injection devices 100 to the high-pressure fuel pump 13 and each of the fuel injection devices 100, based on information obtained from the above sensors.

The fuel injection device 100 directly injects the fuel to the combustion chamber 22. The fuel injection device 100 is mounted to a head member 21 by being inserted into a through hole of the head member 21 that constitutes the combustion chamber 22 of the diesel engine 20. The fuel injection device 100 injects the high-pressure fuel supplied from the fuel pipe 14*d* to the combustion chamber 22 through an injection hole 44. An injection pressure of the fuel injection device 100 is in a level from 160 MPa (megapascals) to 250 MPa (megapascals). The fuel injection device 100 includes the valve mechanism that controls an injection of the high-pressure fuel injected from the injection hole 44. The valve mechanism includes a pressure control valve 35 that operates based on the control signal transmitted from the engine control device 17 (refer to FIG. 2), and a main valve portion 50 that opens and closes the injection hole 44. The fuel injection device 100 uses a part of the high-pressure fuel supplied from the fuel pipe 14*d* to open and close the injection hole 44. The fuel is discharged to a fuel pipe 14*f* that is arranged in the low pressure area, and is returned to the fuel tank 11 through the fuel pipe 14*e*.

Figure 2:
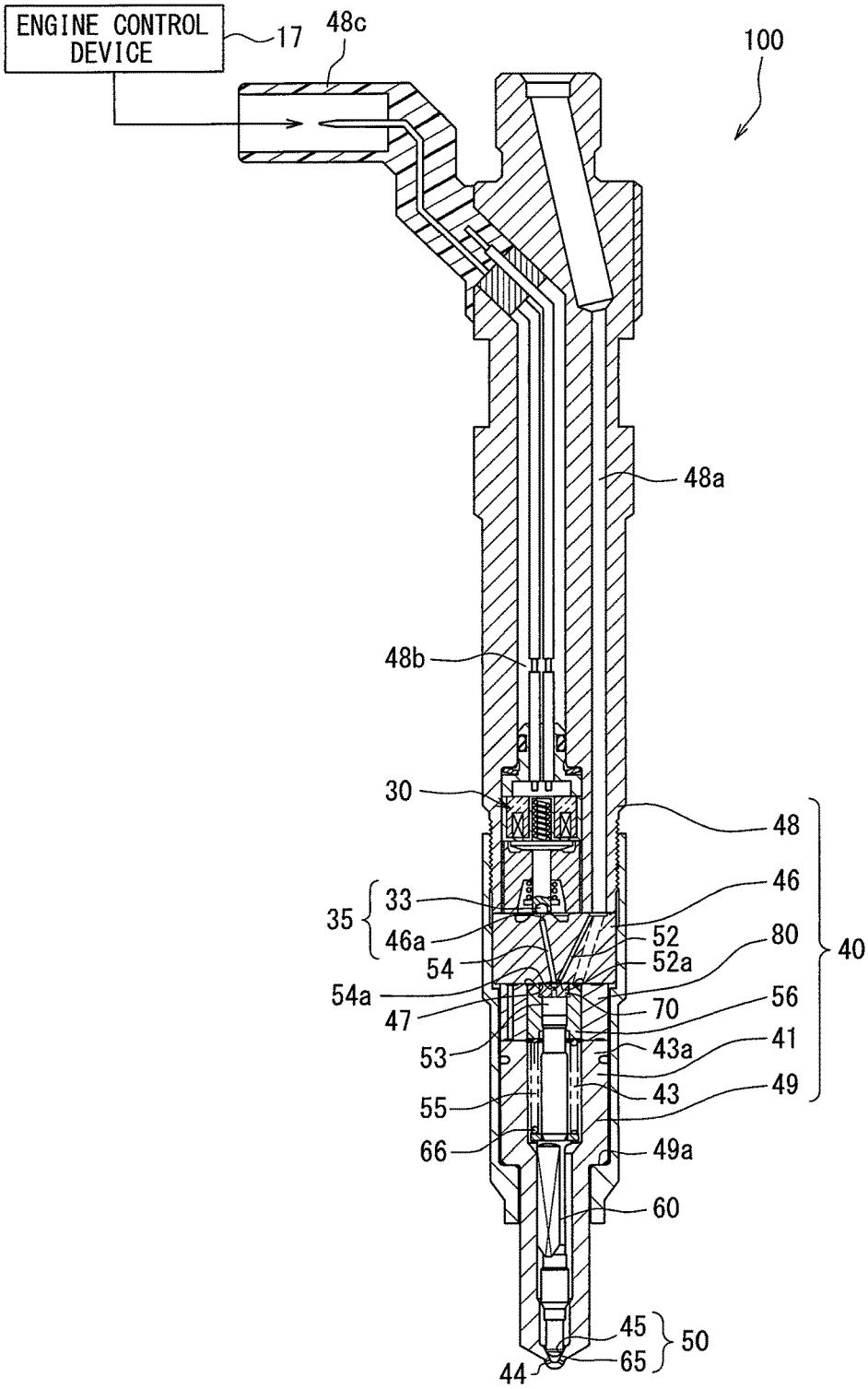
FIG. 2 is a cross-sectional view showing an inner configuration of the fuel injection device.

As shown in FIG. 2, the fuel injection device 100 further includes a driving portion 30, a control body 40, a nozzle needle 60, and a floating plate 70.

The driving portion 30 is received in the control body 40. The driving portion 30 is connected with a control valve face member 33. The control valve face member 33 and a control seat portion 46*a* constitute the pressure control valve 35. The driving portion 30 receives the control signal that is a pulse waveform and is transmitted from the engine control device 17. When the control valve face member 33 displace based on the control signal, the driving portion 30 opens and closes the pressure control valve 35. When a power supply transmitted from the engine control device 17 is interrupted, the driving portion 30 controls the control valve face member 33 to be seated on the control seat portion 46*a*. Thus, the pressure control valve 35 is in a valve-closing state. When the power supply transmitted from the engine control device 17 is allowed, the driving portion 30 controls the control valve face member 33 to be removed from the control seat portion 46*a*. Thus, the pressure control valve 35 is in a valve-opening state.

Figure 3:
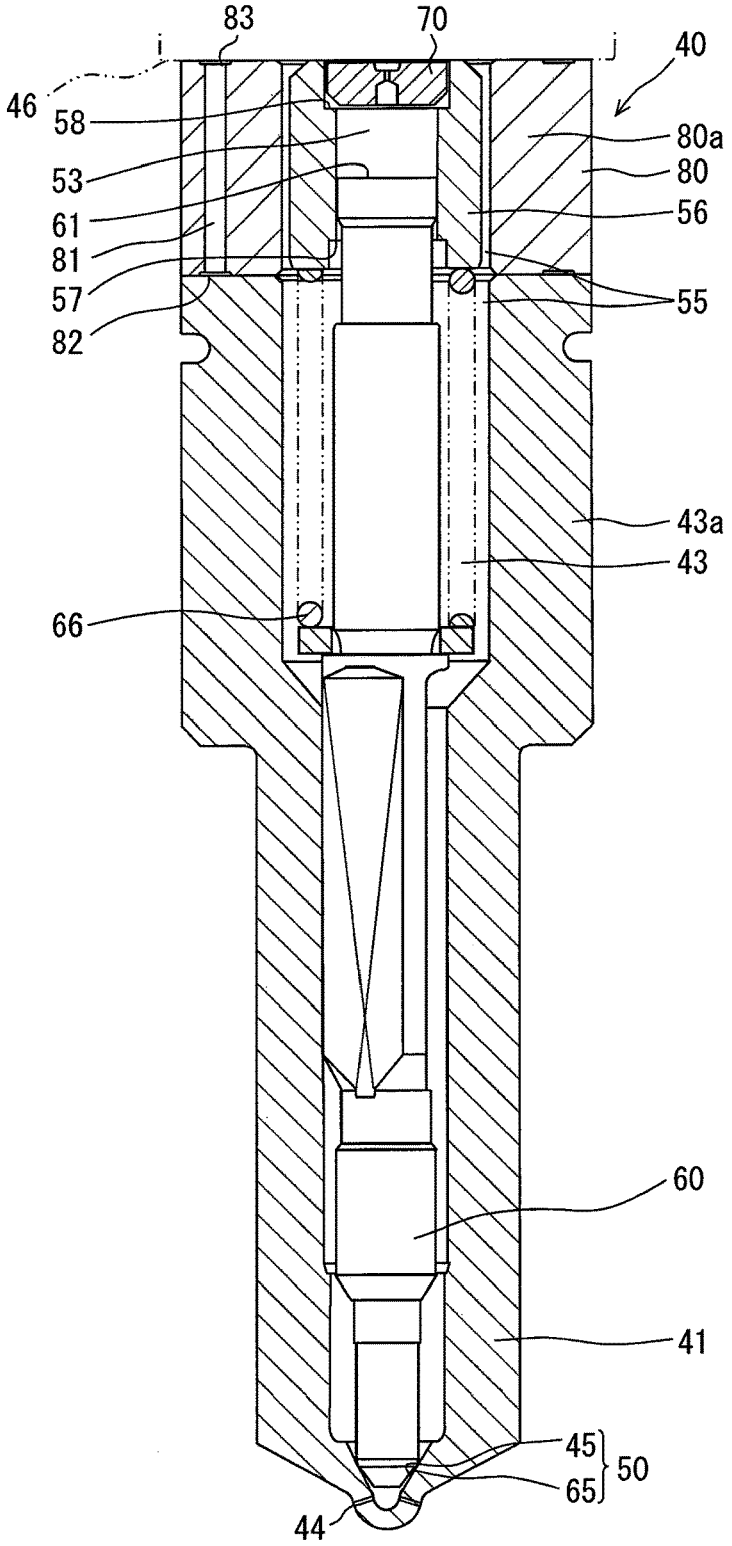
FIG. 3 is an enlarged diagram showing a control body of the fuel injection device.

As shown in FIGS. 2 and 3, the control body 40 includes the injection hole 44, an inflow passage 52, an outflow passage 54, a supply passage 55, and a pressure control chamber 53. The injection hole 44 is arranged at a distal portion of the control body 40 in an inserting direction where the control body 40 is inserted toward the combustion chamber 22 (refer to FIG. 1). The distal portion is a conical shape or a hemisphere shape. Plural injection holes 44 are arranged in radial directions from an interior of the control body 40 towards an exterior of the control body 40. The high-pressure fuel is injected to the combustion chamber 22 through the injection holes 44. After passing through the injection holes 44, the high-pressure fuel atomizes and diffuses to be in a state where the high-pressure fuel is easily mixed with an air.

The inflow passage 52 includes a first passage end that is connected with a vertical hole 48*a*. The inflow passage 52 further includes a second passage end that is connected with the pressure control chamber 53. The high-pressure fuel supplied through the fuel pipe 14*d* (refer to FIG. 1) and the vertical hole 48*a* flows into the pressure control chamber 53 through the inflow passage 52. The outflow passage 54 includes a first passage end that is connected with the pressure control valve 35. The outflow passage 54 further includes a second passage end that is connected with the pressure control chamber 53. When the pressure control valve 35 is opened, the fuel in the pressure control chamber 53 flows to the fuel pipe 14*f* (refer to FIG. 1) through the outflow passage 54.

The supply passage 55 is branched from the inflow passage 52, in the control body 40. The supply passage 55 is a cylindrically-hollowed shape and is arranged to be in contact with plural members constituting the control body 40. The supply passage 55 introduces a communication between the fuel pipe 14*d* (refer to FIG. 1) and the injection hole 44. The high-pressure fuel supplied through the fuel pipe 14*d* flows to the injection hole 44 through the supply passage 55.

The pressure control chamber 53 is placed at a position in the control body 40 opposite to the injection hole 44 with respect to the nozzle needle 60. In other words, the nozzle needle 60 is interposed between the pressure control chamber 53 and the injection hole 44, in the control body 40. In the pressure control chamber 53, the pressure of the fuel varies according to the high-pressure fuel flowing from the inflow passage 52 and the fuel flowing out through the outflow passage 54. The pressure control chamber 53 uses the pressure of the fuel to control a movement of the nozzle needle 60.

The control body 40 includes a nozzle body 41, a cylinder 56, an orifice plate 46, a holder 48, a retaining nut 49, and a spacer 80. The nozzle body 41, the spacer 80, the orifice plate 46, and the holder 48 are arranged in this order from the distal portion of the control body 40 in the inserting direction where the control body 40 is inserted into the head member 21 (refer to FIG. 1).

The nozzle body 41 is a bottomed cylindrical shape and is made of a metal material such as a chrome molybdenum steel. The nozzle body 41 includes the injection hole 44 and a part of the supply passage 55. The nozzle body 41 further includes a nozzle needle receiving chamber 43 and a seat portion 45.

The nozzle needle receiving chamber 43 is a cylindrical hole that is defined by a peripheral wall portion 43*a*. The nozzle needle receiving chamber 43 receives the nozzle needle 60. The nozzle needle receiving chamber 43 is arranged in a direction along an axial direction of the nozzle body 41. The nozzle needle receiving chamber 43 communicates with an opening on an end surface of the nozzle body 41 facing the orifice plate 46. The nozzle needle receiving chamber 43 includes the supply passage 55.

The seat portion 45 is a conical shape and is defined by an inner peripheral wall of the nozzle body 41 that faces the supply passage 55. The seat portion 45 is placed at a position inside of the distal portion, and is in contact with a distal of the nozzle needle 60. The seat portion 45 is mechanically processed by a cutting tool that is an elongated plate shape and is inserted into the opening of the nozzle needle receiving chamber 43. It is necessary that the cutting tool used to process the seat portion 45 has a distal that is made of a material having a high rigidity where the distal is not deformed while being applied by a processing reaction force.

Figure 4:
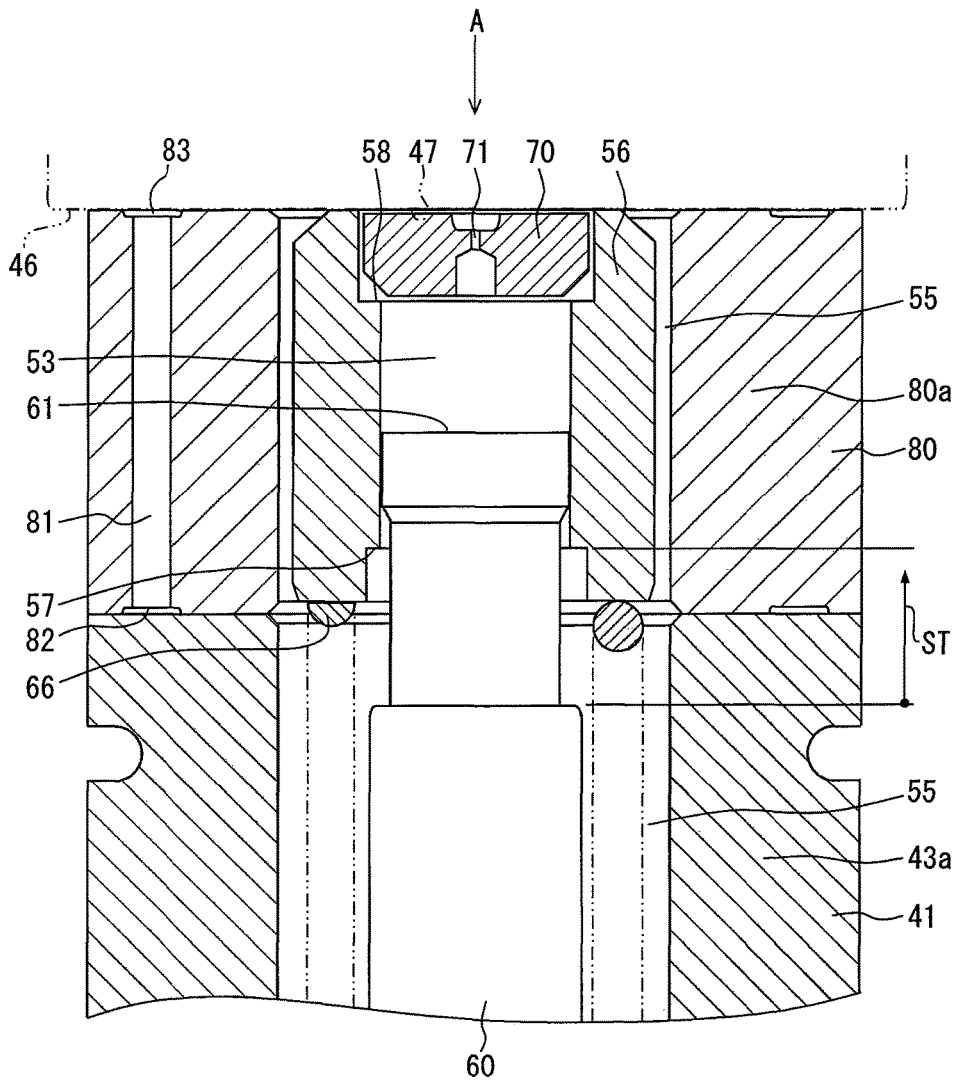
FIG. 4 is an enlarged diagram showing a spacer and components placed in the vicinity of the spacer.

As shown in FIGS. 2 to 4, the cylinder 56 is a cylindrical shape and is made of a metal material. The cylinder 56, the orifice plate 46, and the nozzle needle 60 define the pressure control chamber 53. The cylinder 56 is placed at a position in an interior of the spacer 80 and is arranged coaxially with the spacer 80. The cylinder 56 includes an end surface in an axial direction of the cylinder 56, and the end surface is in contact with the orifice plate 46. The cylinder 56 is slidable relative to the nozzle needle 60 in the axial direction. The cylinder 56 includes a needle stopper 57 and a plate stopper 58. The needle stopper 57 limits the movement of the nozzle needle 60 in a direction toward the floating plate 70 that is a direction where the nozzle needle 60 is separated from the seat portion 45. The plate stopper 58 limits a movement of the floating plate 70 in a direction toward the nozzle needle 60 that is a direction where the floating plate 70 is separated from the orifice plate 46.

As shown in FIG. 2, the orifice plate 46 is a disc shape and is made of a metal material such as a chrome molybdenum steel. The orifice plate 46 includes the inflow passage 52, the outflow passage 54, and a part of the supply passage 55. The orifice plate 46 further includes the control seat portion 46*a* and a contact wall surface portion 47.

The control seat portion 46*a* placed at a top surface of the orifice plate 46 that faces the holder 48. The control seat portion 46*a* and the control valve face member 33 define the pressure control valve 35. The pressure control valve 35 switches to allow and interrupt a communication state between the outflow passage 54 and the fuel pipe 14*f* (refer to FIG. 1).

The contact wall surface portion 47 is placed at a bottom surface of the orifice plate 46 that faces the nozzle needle 60. The contact wall surface portion 47 is an area that is a disc shape and is surrounded by the cylinder 56, in the bottom surface of the orifice plate 46. The contact wall surface portion 47 defines the pressure control chamber 53. The contact wall surface portion 47 communicates with an opening 52*a* of the inflow passage 52 through which the high-pressure fuel flows into the pressure control chamber 53, and communicates with an opening 54*a* of the outflow passage 54 through which the fuel flows out of the pressure control chamber 53. The contact wall surface portion 47 is in contact with the floating plate 70 that is slidable in the pressure control chamber 53 in the axial direction.

The holder 48 is a member that is a cylindrical shape and is made of a metal material such as a chrome molybdenum steel. The holder 48 includes vertical holes 48*a*, 48*b* that are arranged in the axial direction, and a socket portion 48*c*. The vertical hole 48*a* communicates with the fuel pipe 14*d* (refer to FIG. 1), the inflow passage 52, and the supply passage 55. The vertical hole 48*b* receives the driving portion 30. The socket portion 48*c* blocks an opening of the vertical hole 48*b*. The socket portion 48*c* is fitter with a plug portion that is connected with the engine control device 17. The engine control device 17 transmits a control signal that is a pulse waveform to the driving portion 30 through the plug portion that is connected with the socket portion 48*c*.

The retaining nut 49 is a member that is a two-part cylindrical shape that is made of a metal material. The retaining nut 49 receives a part of the nozzle body 41, the spacer 80, and the orifice plate 46 (hereafter, the above three parts are referred to as members 41 to 46), and is screwed with the holder 48. The retaining nut 49 includes a step portion 49*a*. The step portion 49*a* is a step defined in a radial direction of the retaining nut 49. The step portion 49*a* is mounted to the holder 48 of the retaining nut 49, so as to press the members 41 to 46 toward the holder 48. The retaining nut 49 and the holder 48 hold the members 41 to 46.

Figure 5:
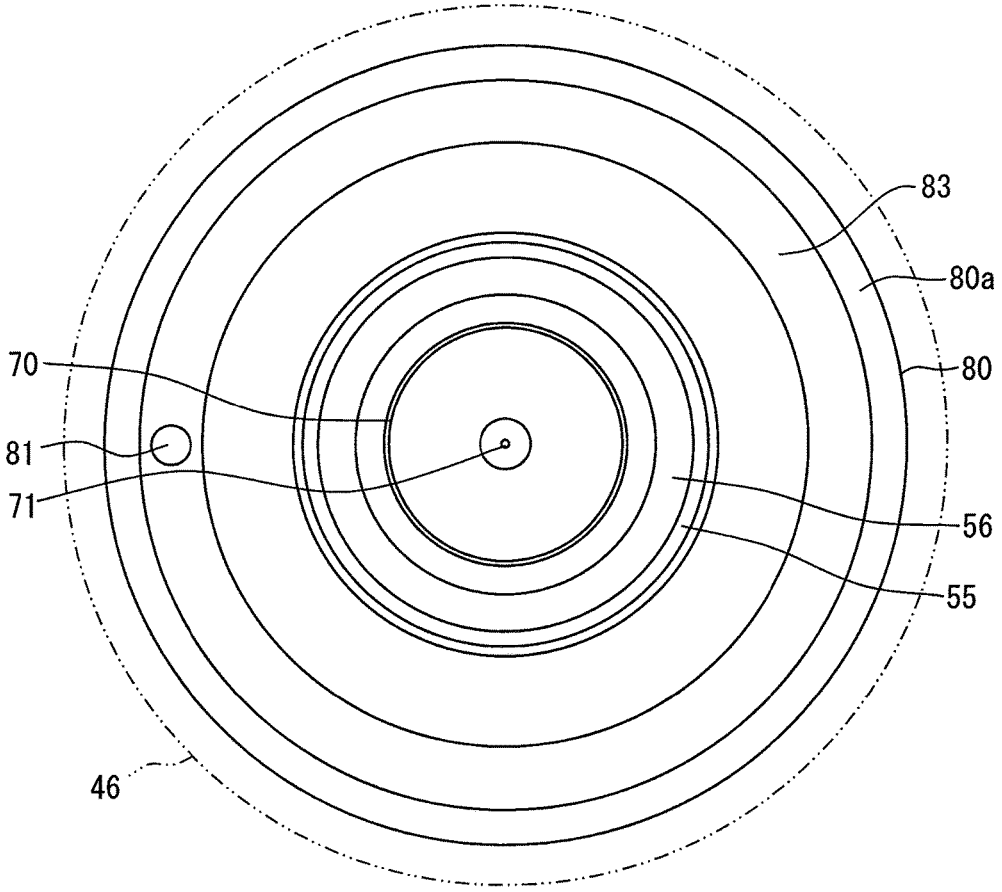
FIG. 5 is a plan view of the spacer the components placed in the vicinity of the spacer, along an arrow A in FIG. 4.

As shown in FIGS. 3 to 5, the spacer 80 is a cylindrical shape and is made of a metal material including a chrome. According to the present embodiment, the metal material may be a high-carbon steel. The spacer 80 is placed at a position between the nozzle body 41 and the orifice plate 46, and is arranged to be coaxial with the nozzle body 41 and the orifice plate 46. The spacer 80 includes an outer peripheral wall 80*a* that is a cylindrical shape. The outer peripheral wall 80*a* includes a collecting passage 81 and two ring-shaped grooves 82, 83.

The outer peripheral wall 80*a* is arranged to be coaxial with the cylinder 56, and surrounds an exterior of an outer periphery of the cylinder 56. The supply passage 55 is interposed between the outer peripheral wall 80*a* and the nozzle body 41. The outer peripheral wall 80*a* has an inner diameter that is substantially the same as an inner diameter of the peripheral wall portion 43*a* of the nozzle body 41. The outer peripheral wall 80*a* has a wall thickness that is substantially the same as a wall thickness of the peripheral wall portion 43*a*.

The collecting passage 81 is included in the outer peripheral wall 80*a* and is placed at a position outward of the supply passage 55 in the radial direction. The collecting passage 81 is a cylindrical hole and extends in an axial direction of the spacer 80. The collecting passage 81 communicates with two openings on bottom surfaces of the ring-shaped grooves 82, 83. The collecting passage 81 is a fuel passage that collects a leakage fuel that is the fuel leaked from the supply passage 55 between the spacer 80 and the orifice plate 46.

The ring-shaped grooves 82, 83 are placed at end surfaces of the outer peripheral wall 80*a* in the axial direction, respectively. The ring-shaped grooves 82, 83 are depression grooves that are depressed from the end surfaces to be depression shaped. The ring-shaped grooves 82, 83 are ring shaped to be coaxial with the outer peripheral wall 80*a*. Shapes of the ring-shaped grooves 82, 83 are the same as each other. The ring-shaped grooves 82, 83 include a first ring-shaped groove 82 and a second ring-shape groove 83. The leakage fuel that is leaked from the supply passage 55 between the spacer 80 and the nozzle body 41 flows into the first ring-shaped groove 82 that faces the nozzle body 41. The leakage fuel flows to the second ring-shaped groove 83 that faces the orifice plate 46 through the collecting passage 81. The leakage fuel is discharged to the fuel pipe 14*f* (refer to FIG. 1) through a fuel passage in the orifice plate 46.

The spacer 80 is symmetrically shaped in the axial direction. Specifically, the spacer 80 is a symmetrical with respect to a cross sectional surface that is imagined and is placed at a position including a center of the spacer 80 in the axial direction. Thus, the spacer 80 can be arranged in a manner that a top surface of the spacer 80 and a bottom surface of the spacer 80 is reversed. Since the ring-shaped grooves 82, 83 are ring shaped, a position of the collecting passage 81 in a peripheral direction may be not limited. Then, the spacer 80 can be disposed between the nozzle body 41 and the orifice plate 46, without limiting a position of the spacer 80 in the peripheral direction.

As shown in FIGS. 3 and 4, the nozzle needle 60 is a columnar shape and is made of a metal material such as a high speed tool steel. The nozzle needle 60 is slidable relative to the nozzle body 41 in the axial direction, in an interior of the nozzle body 41. The nozzle needle 60 is biased toward the seat portion 45 by a return spring 66 in which a wire member made of a metal material is spirally wound. The nozzle needle 60 includes a face portion 65 and a valve pressure receiving surface 61.

The face portion 65 is placed at a distal portion of the nozzle needle 60 that faces the seat portion 45, between two distal portions of the nozzle needle 60. The face portion 65 is a conical shape that an outer diameter of the face portion 65 decreases toward a distal end of the face portion 65. The face portion 65 is seated on or removed from the seat portion 45 according to the movement of the nozzle needle 60. The face portion 65 and the seat portion 45 constitute the main valve portion 50 opening and closing the injection hole 44.

The valve pressure receiving surface 61 is placed at a distal portion of the nozzle needle 60 that is closer to the pressure control chamber 53, between the two distal portions of the nozzle needle 60. The valve pressure receiving surface 61, the orifice plate 46, and the cylinder 56 define the pressure control chamber 53. The face portion 65 of the nozzle needle 60 is seated on or removed from the seat portion 45, according to a variation of a fuel pressure received by the valve pressure receiving surface 61.

As shown in FIGS. 2, 4, and 5, the floating plate 70 is a disc shape and is made of a metal material. The floating plate 70 is arranged in the pressure control chamber 53. The floating plate 70 is slidable relative to the nozzle body 41 in the axial direction. The floating plate 70 is pressed to the contact wall surface portion 47 by the pressure of the fuel that is in the pressure control chamber 53 and intends to flow out from the outflow passage 54. Then, the floating plate 70 that is attracted toward the outflow passage 54 blocks the opening 52*a* of the inflow passage 52. Thus, the high-pressure fuel entering the pressure control chamber 53 from the inflow passage 52 is prevented.

The floating plate 70 includes a communication hole 71. The communication hole 71 is placed at a center of the floating plate 70 in a radial direction of the floating plate 70. The communication hole 71 penetrates the floating plate 70 in the axial direction. When the floating plate 70 blocks the opening 52*a* of the inflow passage 52, the floating plate 70 controls the fuel to flow from the pressure control chamber 53 to the outflow passage 54 through the communication hole 71 at a predetermined flow volume.

Next, operations executed by the fuel injection device 100 to open and close the injection hole 44 will be described. When the pressure control valve 35 is opened, the outflow passage 54 communicates with the fuel pipe 14*f* (refer to FIG. 1). Then, the floating plate 70 that is attracted by the outflow passage 54 according to the fuel flowing out of the pressure control chamber 53 blocks the opening 52*a* of the inflow passage 52. Thus, the high-pressure fuel introduced to the pressure control chamber 53 is prevented, and the fuel continuously flows out through the communication hole 71. Then, a decreasing of the fuel pressure in the pressure control chamber 53 is rapidly achieved, the nozzle needle 60 rapidly moves toward the pressure control chamber 53, and the injection hole 44 becomes in an open state.

The nozzle needle 60 moves in a direction separating from the seat portion 45, without being in contact with the needle stopper 57. When the communication state between the outflow passage 54 and the fuel pipe 14*f* (refer to FIG. 1) is interrupted while the pressure control valve 35 is closed, the floating plate 70 is pressed by the fuel of the inflow passage 52 to move in a direction separating from the contact wall surface portion 47. As the above description, when the pressure in the pressure control chamber 53 is recovered, the nozzle needle 60 rapidly moves toward the seat portion 45, and the injection hole 44 becomes in a close state.

In the above operations, the nozzle needle 60 has a maximum stroke ST (refer to FIG. 4) that is previously established in the direction that the nozzle needle 60 is separated from the seat portion 45. When the nozzle needle 60 moves by a distance greater than the maximum stroke ST due to an abnormality, the nozzle needle 60 becomes in contact with the needle stopper 57, and the movement of the nozzle needle 60 is limited. In a normal operation, the nozzle needle 60 moves by a distance less than or equal to the maximum stroke ST and starts an injection of the fuel injected from the injection hole 44, without being in contact with the needle stopper 57. According to the present embodiment, the maximum stroke ST can be extended, without deteriorating a processing accuracy of the seat portion 45.

Specifically, according to the present embodiment, the spacer 80 defines the supply passage 55 arranged at a position outward of the pressure control chamber 53 in the radial direction. Thus, when the pressure control chamber 53 and the cylinder 56 are enlarged in the axial direction while the maximum stroke ST of the nozzle needle 60 is extended, the spacer 80 may be enlarged in the axial direction. In this case, a size of the nozzle body 41 is maintained.

When the size of the nozzle body 41 is extended in the axial direction, a distance from the opening of the nozzle needle receiving chamber 43 to the seat portion 45 becomes larger. Thus, it is necessary to use a cutting tool that is a more elongated shape to process the seat portion 45. A rigidity of a cutting tool decreases in accordance with an increase in length of the cutting tool. Thus, it is remarkably difficult that the processing accuracy of the seat portion 45 is maintained.

In contrast, according to the present embodiment, the size of the nozzle body 41 is maintained, and the above difficult condition can be prevented. Thus, a deterioration of the processing accuracy of when the seat portion 45 is processed on the nozzle body 41 can be suppressed, and a stroke amount of the nozzle needle 60 can be ensured.

According to the present embodiment, when the pressure of the fuel is excessively increased, the leakage fuel leaked from the fuel injection device 100 can be prevented. Specifically, the fuel injection device 100 includes the collecting passage 81 that is arranged at a position outward of the supply passage 55 in the radial direction. When the leakage fuel leaked from the supply passage 55 is generated due to a load of the high-pressure fuel that is abnormal and is unexpected, the leakage fuel can be certainly collected by the collecting passage 81. Thus, even when the spacer 80 is added, the leakage fuel can be certainly prevented.

According to the present embodiment, in the spacer 80, a variation of a parallel relationship between two end surfaces of the outer peripheral wall 80*a* unavoidably occurs. The variation of the parallel relationship leads to a shifting amount of a center axis of the nozzle body 41 relative to a center axis of the fuel injection device 100 in a case where the shifting amount increases in accordance with an increase in length of the outer peripheral wall 80*a* in the axial direction. According to the present embodiment, it is preferable that the length of the outer peripheral wall 80*a* in the axial direction is shorter than an outer diameter of the outer peripheral wall 80*a*. As the above shape of the spacer 80, a parallel relationship between the top surface and the bottom surface can be ensured in a wide range, and the shifting amount of the center axis of the nozzle needle 60 can be suppressed to be in an allowable range.

According to the present embodiment, it is preferable that the inner diameter and the wall thickness of the outer peripheral wall 80*a* of the spacer 80 match with the inner diameter and the wall thickness of the peripheral wall portion 43*a* of the nozzle body 41, respectively. As the above configuration, the outer peripheral wall 80*a* obtains a strength that is optimal relative to the pressure of the fuel flowing through the supply passage 55. Further, it can be prevented that an outer diameter of the fuel injection device 100 is enlarged.

According to the present embodiment, the nozzle needle 60 continuously moves during a time interval where the injection hole 44 is in the open state. Thus, it is necessary to ensure that the maximum stroke St of the nozzle needle 60 is longer. It is suitable that the fuel injection device 100 in which the movement of the nozzle needle 60 is not limited by the needle stopper 57 in a normal operation has a configuration where a maintaining of the processing accuracy of the seat portion 45 is compatible with an extending of the maximum stroke ST by using the spacer 80.

In the above configuration where the movement of the nozzle needle 60 is not limited, the floating plate 70 continuously blocks the opening 52*a* of the inflow passage 52 until the pressure control valve 35 is closed. Thus, when the pressure control valve 35 is opened, the fuel flowing from the inflow passage 52 to the outflow passage 54 through the pressure control chamber 53 is reduced. Then, the fuel is not injected from the injection hole 44, and the leakage fuel returned to the fuel tank 11 can be reduced.

According to the present embodiment, the diesel engine 20 is equivalent to the internal combustion engine, the nozzle body 41 is equivalent to a valve body, and the orifice plate 46 is equivalent to an orifice member. The opening 52*a* is equivalent to an inflow inlet, the supply passage 55 is equivalent to a fuel passage, and the cylinder 56 is equivalent to a dividing member. The needle stopper 57 is equivalent to a limiting portion, the nozzle needle 60 is equivalent to a valve member, and the floating plate 70 is equivalent to a pressing member. The spacer 80 is equivalent to an outer peripheral member.

Other Embodiment

The present disclosure is described according to the above embodiment. However, the present disclosure is not limited to the embodiment mentioned above, and can be applied to various embodiments within the spirit and scope of the present disclosure.

Figure 6:
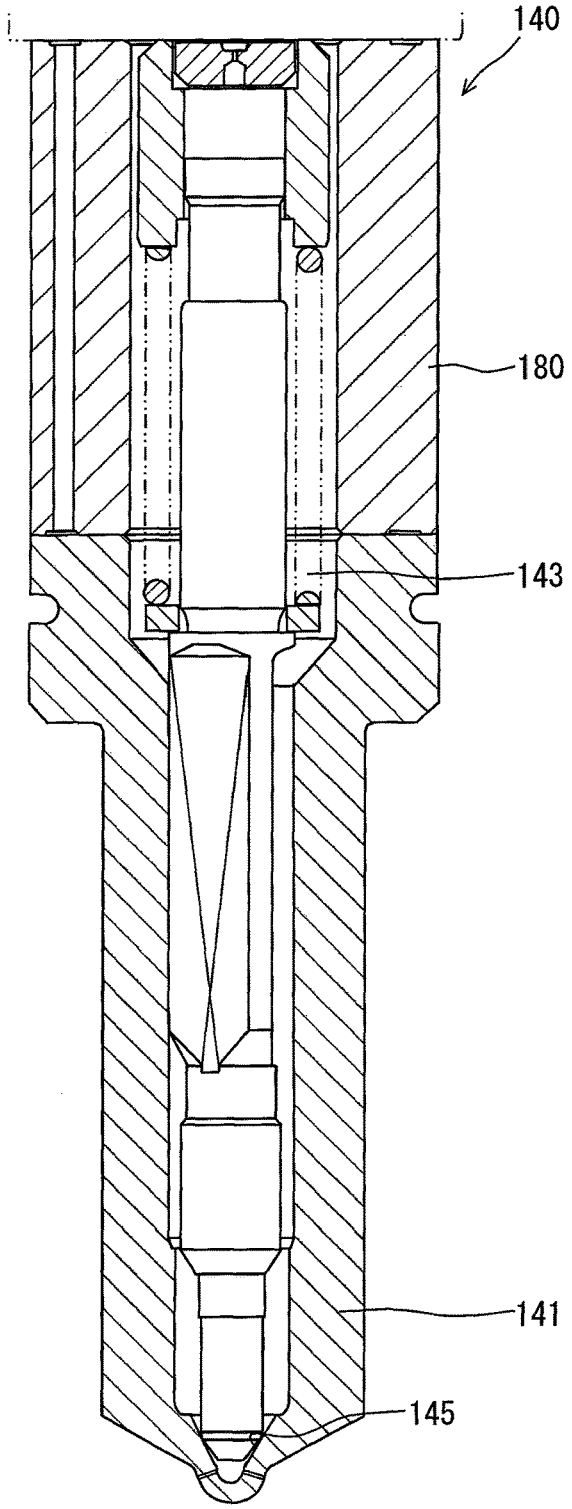
FIG. 6 is a diagram showing a modification example in FIG. 3.

According to the above embodiment, a length of the spacer 80 in the axial direction is shorter than an outer diameter of the spacer 80 and is in a level the same as the cylinder 56. However, a shape of the spacer can be properly changed. For example, in a modification example shown in FIG. 6, a control body 140 includes a spacer 180, and the spacer 180 has a length in the axial direction longer than an outer diameter of the spacer 180. When the spacer 180 is used, a length of a nozzle body 141 in the axial direction can be further decreased. Then, since a distance from an opening of a nozzle needle receiving chamber 143 to a seat portion 145 is decreased, a processing accuracy of the seat portion 145 is further readily ensured. In the above modification example, the nozzle body 141 is equivalent to the valve body, and the spacer 180 is equivalent to the outer peripheral member.

An inner diameter and the wall thickness of the spacer may be different from that of the nozzle body, respectively. A constitution in which the collecting passage 81 and the ring-shaped grooves 82, 83 is provided may be cancelled from the spacer. Specifically, a ring-shaped groove that is a ring shape and is equivalent to the ring-shaped groove 83 may be placed at a position on an end surface of the orifice plate that is in contact with the spacer. Similarly, a ring-shaped groove that is a ring shape and is equivalent to the ring-shaped groove 82 may be placed at a position on an end surface of the nozzle body that is in contact with the spacer.

According to the above embodiment, it is simple to provide different fuel injection devices by a capacity of the pressure control chamber 53. Specifically, when the fuel injection device 100 is being manufactured, one of plural members that are different in length in the axial direction along a moving direction that the nozzle needle 60 moves is selected as the cylinder 56. In this case, the direction the nozzle needle 60 moves is referred to as a movement direction of the nozzle needle 60. Since the cylinder 56 defining the pressure control chamber 53 is determined by a selection, the capacity of the pressure control chamber 53 can be readily changed. Further, one of plural members that have different length in the axial direction is selected as the spacer 80 that corresponds to the cylinder 56. The length of the spacer 80 that is selected in the axial direction can be changed according to the length of the cylinder 56 in the axial direction. In this case, the length of the spacer 80 may correspond to the length of the cylinder 56, in the axial direction. More specifically, the length of the spacer 80 may be equal to the length of the cylinder 56, in the axial direction. As the above configuration, even when the pressure control chamber 53 and the cylinder 56 are enlarged in the axial direction, it is prevented that the nozzle needle 60 is enlarged in the axial direction. Thus, stroke amounts of plural types can be ensured, without deteriorating the processing accuracy of the seat portion 45. Further, an increasing of types of the nozzle body 41 can be suppressed.

According to the above embodiment, the nozzle body defining the seat portion uses a material that is better at processing than a material used in the spacer that is a simply cylindrical member. The spacer may use a material the same as the nozzle body does.

According to the above embodiment, effects of solving an antinomy between an enlarging of the stroke and a maintaining of the processing accuracy of the seat portion are effectively efficient to balance a decreasing of the leakage fuel and an increasing of an injection amount when being applied to an embodiment where a nozzle needle is not in contact with a needle stopper in a normal operation. However, the present disclosure can also be applied to a fuel injection device of an embodiment where a nozzle needle is in contact with a needle stopper in a normal operation. Further, the present disclosure can also be applied to a fuel injection device of an embodiment where a pressure control chamber does not include a floating plate. In addition, the needle stopper limiting a stroke in an abnormal operation according to the above embodiment may be cancelled from the cylinder.

As the above description, the fuel injection device used in the diesel engine is described. However, the present disclosure is not limited to the diesel engine, and can be applied to a fuel injection device used in an internal combustion engine including an Otto cycle engine. Further, the fuel injected by the fuel injection device is not limited to the light oil, and may be a dimethyl ether, a liquefied petroleum gas, or a gasoline.

While the present disclosure has been described with reference to the embodiments thereof, it is to be understood that the disclosure is not limited to the embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

The invention claimed is:

1. A fuel injection device injecting a fuel that is supplied from an injection hole to a combustion chamber of an internal combustion engine, the fuel injection device comprising:

a valve body including a fuel passage through which the fuel flows to the injection hole, and a seat portion facing the fuel passage;

a valve member moving in the valve body in an axial direction of the valve body, the valve member opening and closing the injection hole by being removed from and seated on the seat portion;

a dividing member defining a pressure control chamber placed at a position opposite to the injection hole with respect to the valve member, the pressure control chamber controlling a movement of the valve member by a pressure of the fuel that is introduced; and an outer peripheral member surrounding an exterior of an outer periphery of the dividing member, the outer peripheral member and the valve body constituting the fuel passage, wherein:

the outer peripheral member includes a collecting passage placed at a position outward of the fuel passage, and the collecting passage collects the fuel leaked from the fuel passage between the outer peripheral member and the valve body; and the collecting passage is a cylindrical hole that extends in an axial direction of the outer peripheral member.

2. The fuel injection device according to claim 1, wherein the outer peripheral member includes an outer peripheral wall that is a cylindrical shape and surrounds an exterior of the fuel passage, and the outer peripheral member has a length in the axial direction that is shorter than an outer diameter of the outer peripheral member.

3. The fuel injection device according to claim 2, wherein the valve body includes the fuel passage that is a cylindrically-hollowed shape and receives the valve member, and the outer peripheral wall has an inner diameter that is the same as an inner diameter of the valve body.

4. The fuel injection device according to claim 2, wherein the outer peripheral wall has a wall thickness that is the same as a wall thickness of a peripheral wall portion surrounding the fuel passage in the valve body.

5. The fuel injection device according to claim 1, wherein the valve member moves in a direction that the valve member is separated from the seat portion by a distance less than or equal to a maximum stroke that is previously established, and starts an injection of the fuel injected from the injection hole, and the dividing member includes a limiting portion limiting the movement of the valve member from the valve member exceeding the maximum stroke.

6. The fuel injection device according to claim 1, further comprising:

an orifice member placed at a position opposite to the valve body with respect to the outer peripheral member, the orifice member including an inflow inlet through which the fuel flows to the pressure control chamber; and a pressing member arranged in the pressure control chamber, the pressing member preventing an entering of the fuel from the inflow inlet to the pressure control chamber while being pressed to the orifice member by the pressure of the fuel in the pressure control chamber.

7. The fuel injection device according to claim 1, wherein the dividing member is selected to be one of plural members that are different in length along a moving direction that the valve body moves.

8. The fuel injection device according to claim 7, wherein the outer peripheral member is selected to be one of the members that are different in length along the moving direction, and the outer peripheral member has the length corresponding to the length of the dividing member.

* * * * *